US007997765B2

(12) United States Patent
Johnson

(10) Patent No.: US 7,997,765 B2
(45) Date of Patent: Aug. 16, 2011

(54) UNDERWATER LAMP

(76) Inventor: Andrew Johnson, Clearwater, FL (US)

( * ) Notice: Subject to any disclaimer, the term of this patent is extended or adjusted under 35 U.S.C. 154(b) by 263 days.

(21) Appl. No.: 12/212,574

(22) Filed: Sep. 17, 2008

(65) Prior Publication Data

US 2009/0231863 A1 Sep. 17, 2009

(30) Foreign Application Priority Data

Mar. 13, 2008 (GB) ..... 0804601.3

(51) Int. Cl.
*F21V 29/00* (2006.01)

(52) U.S. Cl. ..... 362/267; 362/362

(58) Field of Classification Search ..... 362/267, 362/370, 362, 101, 223, 225, 235, 318, 477
See application file for complete search history.

(56) References Cited

U.S. PATENT DOCUMENTS

| | | | | |
|---|---|---|---|---|
| D235,797 | S | 7/1975 | Friedberg | D26/68 |
| D318,136 | S | 7/1991 | Kira | D26/68 |
| D365,166 | S | 12/1995 | Harris et al. | D26/68 |
| D371,620 | S | 7/1996 | Cool | D26/68 |
| 5,649,760 | A * | 7/1997 | Beadle | 362/270 |
| 5,692,828 | A | 12/1997 | Chung | 362/431 |
| D426,011 | S | 5/2000 | Giese et al. | D26/68 |
| D444,253 | S | 6/2001 | Blanchard | D26/67 |
| D468,042 | S | 12/2002 | Volpe | D26/67 |
| D479,891 | S | 9/2003 | Yeh | D26/67 |
| D494,698 | S | 8/2004 | Hon et al. | D26/67 |
| D542,959 | S | 5/2007 | Yao | D26/68 |
| D597,698 | S | 8/2009 | Lee | D26/68 |
| 2006/0221595 | A1 * | 10/2006 | Payne | 362/101 |
| 2008/0278953 | A1 * | 11/2008 | Haugaard | 362/365 |
| 2009/0109675 | A1 * | 4/2009 | Navarro Alvarez | 362/249.02 |
| 2010/0246195 | A1 * | 9/2010 | Muller et al. | 362/375 |

FOREIGN PATENT DOCUMENTS

| | | |
|---|---|---|
| CA | 1171828 | 4/1982 |
| GB | 821461 | 10/1959 |

* cited by examiner

*Primary Examiner* — Evan Dzierzynski
(74) *Attorney, Agent, or Firm* — Hayes Soloway P.C.

(57) ABSTRACT

A submersible light assembly comprises at least one light source and a watertight housing having a base, at least one sidewall and a transparent envelop enclosing a portion of the light source. The base incorporates two concave indentations set substantially orthogonal to each other to substantially conform to the profile of the surface profile pilework of the type associated with a jetty, such that the light assembly can be placed against the pilework in any one of four configurations.

28 Claims, 10 Drawing Sheets

FIG. 9
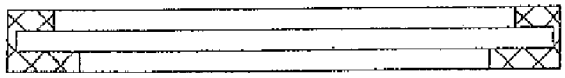
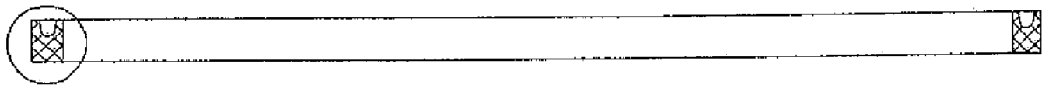
FIG. 10
DETAIL A
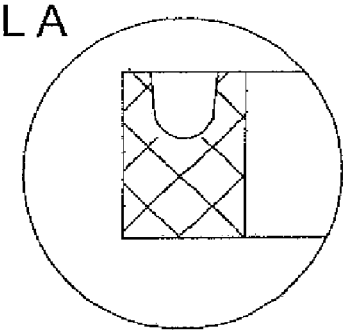
FIG. 11
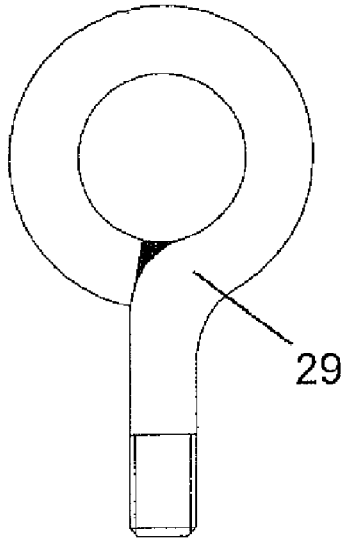
FIG. 12

UNDERWATER LAMP

FIELD OF THE INVENTION

The present invention relates to underwater lighting technology. It is particularly applicable, but in no way limited, to a submersible lighting device or lamp.

BACKGROUND TO THE INVENTION

Lamps for underwater use are available for various applications. One such application is for illuminating the water around a landing stage or jetty at night. Use of underwater lamps in this application has a number of uses and advantages. They can be a safety feature, by improving visibility in that area. They can be an aesthetic feature, but importantly they can also be used to attract fish. It will be appreciated that this fish-attracting application can be used not only near to or around a landing stage, but anywhere where there is access to a suitable electricity supply. This can include use from a boat or yacht with an electrical generator. This type of use results in a number of inherent problems. Firstly, the lamp must be secured in some way, either on the sea or river bed near the jetty or near a boat, or to supporting pilework associated with the jetty itself. Seabeds or riverbeds close to the shore are generally very soft due to the deposit of sediment or sand. As a consequence, the stable location of a lamp is problematic. This situation is made worse by motorboat traffic passing over the lights, sometimes at speed, creating a considerable wash or wake which can dislodge a light sitting on the bottom.

An alternative is to affix the lamp to pilework under the jetty, but this may also be problematic since piles can have a number of different profiles.

In addition, it is necessary to be able to change a blown bulb quickly or easily. Some prior art submersible lamps are "sealed for life" units, where a waterproof seal around the bulb is formed by setting the bulb itself in concrete or a resin. Whilst this may be a cost-effective form of construction initially, the unit must be scrapped if the bulb blows.

It is an object of the present invention to overcome or at least mitigate some or all of the problems mentioned above.

SUMMARY OF THE INVENTION

According to the present invention there is provided a submersible light assembly comprising:

(i) at least one light source;

(ii) a watertight housing having a base, at least one sidewall and a transparent envelope enclosing a portion of the light source;

wherein at least a portion of an outer face of the base of the housing is profiled to substantially conform to the profile of the surface profile of pilework of the type associated with a jetty. By shaping the base in this way, and as described below, it facilitates securing the light to the underwater structure of a jetty.

Preferably a portion of the base is curved, preferably in a concave shape. Very often the pilework associated with a jetty is circular in cross-section and a concave, indented shape in the base makes for an easier and more secure fixing.

Preferably the base incorporates two concave indentations set substantially orthogonal to each other. This arrangement means that the light assembly can be positioned in one of four possible configurations. In this way the power supply cable to the light assembly can be positioned in a convenient orientation.

Preferably the assembly further comprises a support bracket adapted to be secured to pilework and to partially take the weight of the light assembly. Having a separate bracket means that this can be secured to the pilework during the installation, at the appropriated depth, to take a portion of the weight of the assembly, both during and after installation.

Preferably the assembly further comprises a cable entry point adapted to form a waterproof seal between an electrical cable or conduit and the assembly.

In a particularly preferred embodiment the support bracket is so sized and shaped to be adapted to engage with the cable entry point in order to partially support the lamp assembly in use.

Preferably the assembly housing further comprising eyelets adapted to accommodate one or more straps to strap the light assembly to a pile. Tightly strapping the light assembly to pilework is a preferred method of fixing the assembly under water.

In a particularly preferred embodiment the assembly further comprises a demountable ground engaging spike, and wherein the demountable ground-engaging spike is secured to the base of the light assembly using spike securing means. This provides an alternative means of securing the light assembly in place, this time on the sea or riverbed. Downward pressure on the light assembly drives the spike into the bed and the spike anchors it there.

Preferably said housing comprises a base, a body portion and said transparent envelope with sealing gaskets between adjacent components.

Preferably said base incorporates a weight. Because there must be space between the transparent envelope and the light source, and around the electrical components within the housing, additional weight is needed to reduce the natural buoyancy of the assembly when submerged.

According to a further embodiment of the present invention there is provided a submersible light assembly comprising at least one light source, a watertight housing having a base, at least one sidewall and a transparent envelope enclosing a portion of the light source; and a demountable ground engaging spike. The feature of a demountable spike, secured to the assembly by securing means, can be employed without the need to incorporate a profiled base. The features described above, and in the description below, in respect of a first embodiment of the invention can be applied equally well to this second embodiment.

According to a yet further embodiment, there is provided a submersible light assembly comprising at least one light source, a watertight housing having a base, at least one sidewall and a transparent envelope enclosing a portion of the light source, and eyelets adapted to accommodate one or more straps to strap the light and assembly to a pile of the type associated with a jetty.

BRIEF DESCRIPTION OF THE DRAWINGS

The present invention will now be described, by way of example only, with reference to the following drawings wherein:

FIG. 9 shows a sealing gasket for a bulb cover;

FIG. 10 shows a sealing gasket for the waterproof joint between the upper part and the base part of a housing;

FIG. 11 shows detail 'A' from FIG. 10;

FIG. 12 shows a lifting eye;

DESCRIPTION OF THE PREFERRED EMBODIMENTS

Figure 1:
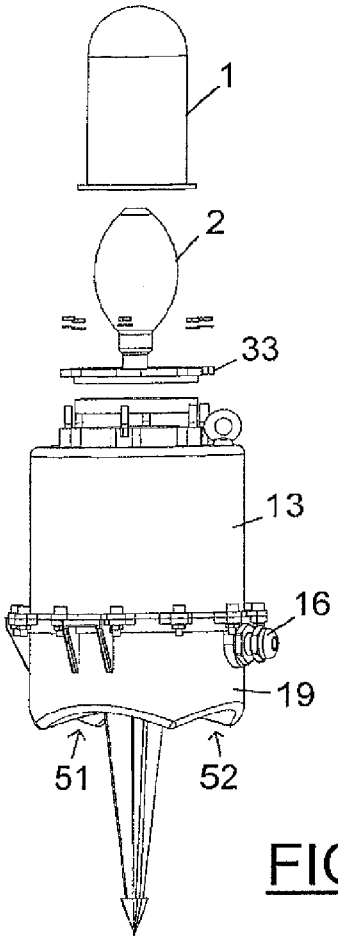
FIG. 1 shows a light assembly according to the present invention with the bulb cover removed.
Figure 2:
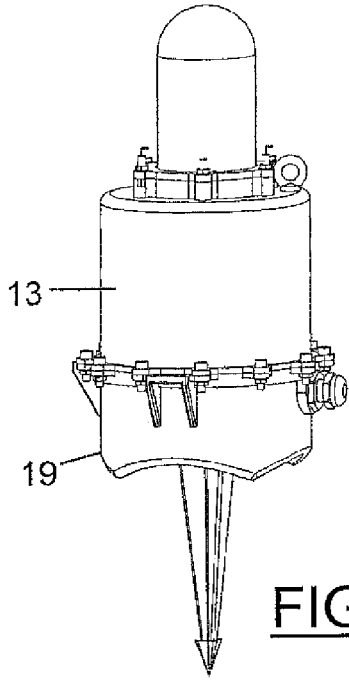
FIGS. 2, 3 and 4 show side, top and bottom elevations of an assembled light assembly of FIG. 1.
Figure 3:
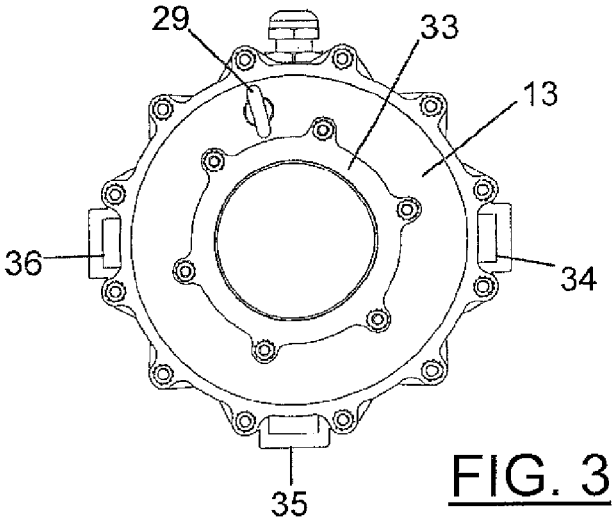
Figure 4:
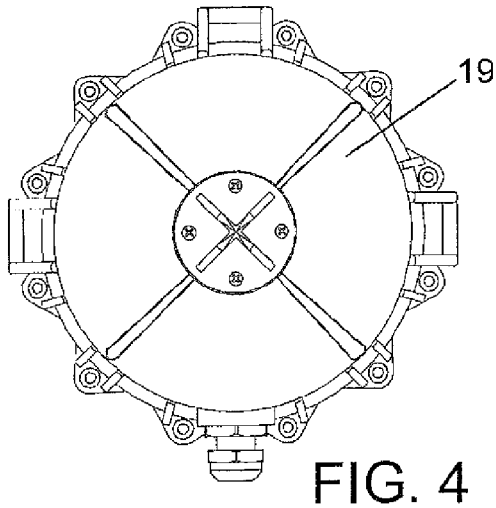

Preferred embodiments will now be described by way of example only. They are not the only way the invention can be put into practice but they are the best ways currently known to the applicant.

Referring to FIGS. 1 to 4, these show various elevation views of a first embodiment of the submersible lamp assembly. They show a substantially watertight housing assembly consisting of a base portion 19, an upper portion of the housing 13, a bulb or lamp 2 and a transparent envelope or lamp cover 1. A flange ring 33, held in place by a number of nuts, bolts and washers, acts to compress the lamp cover against a fluid-tight sealing gasket, shown in more detail in FIG. 9.

A similar, but larger fluid-tight gasket, shown in FIG. 10, is positioned between the base portion and the upper portion of housing, also held in place by a plurality of nuts, bolts and washers.

It will be seen from these figures, the base portion is substantially circular cylindrical with a continuous side wall and a closed end wall. Other than the open top end to the cylinder, which is flanged to form a good fluid-tight seal with upper portion, the only other penetration into the base portion is fluid-tight cable gland 16 containing a bush 17, shown in FIG. 5. This allows an electrical supply cable to enter the base in a fluid-tight manner.

Similarly the upper portion of the housing is substantially circular cylindrical with a flange at its lower end to mate with the base portion and a smaller diameter flange at its upper end to mate with the bulb cover.

Figure 5:
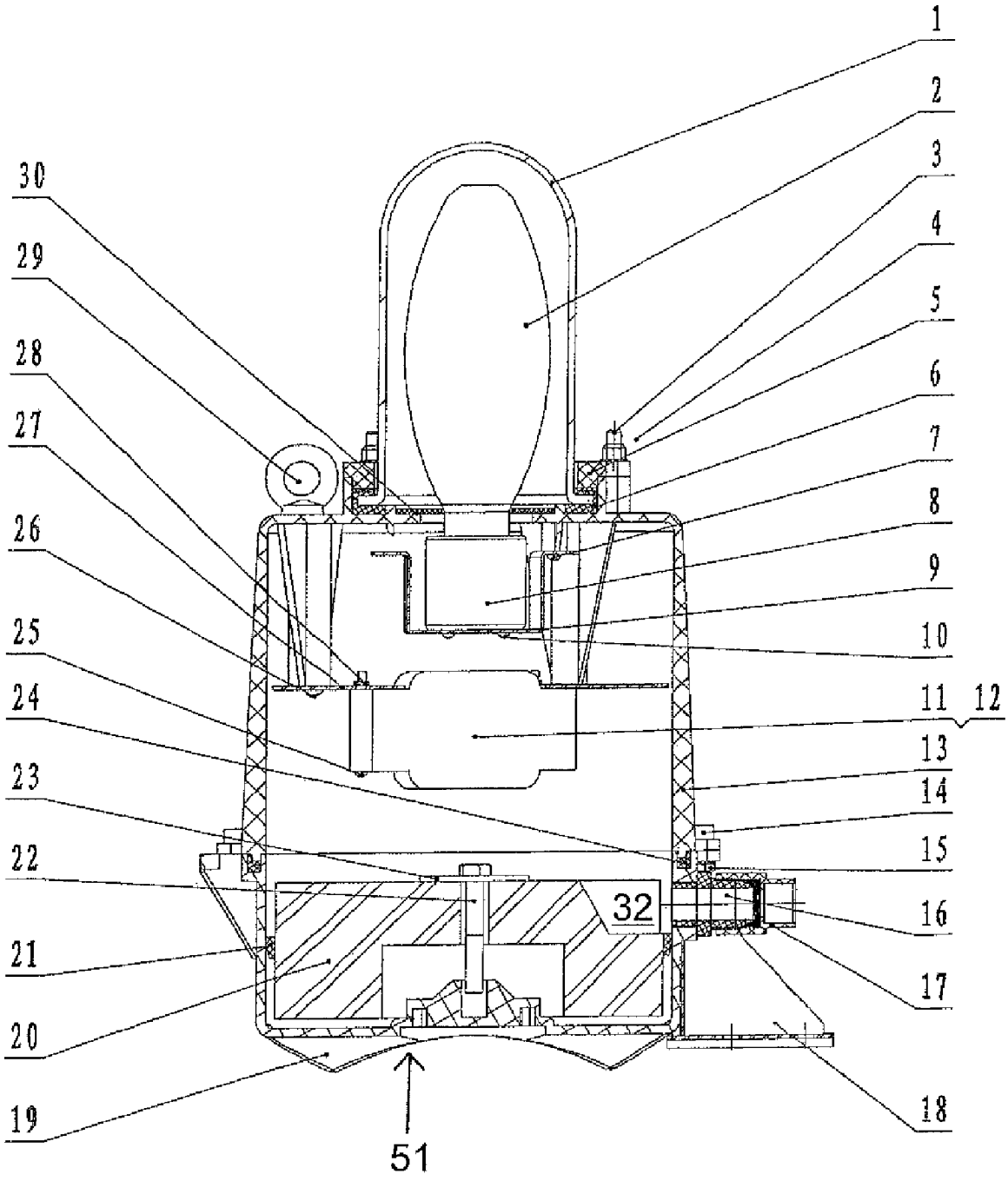
FIG. 5 shows a cross-section through the light assembly of FIG. 1.
Figure 6A:
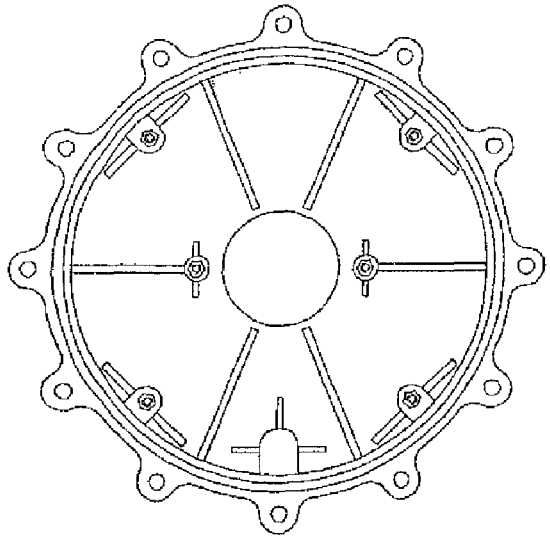
FIGS. 6A to C show bottom, side and top elevations of an upper part of the housing of a light assembly.
Figure 6B:
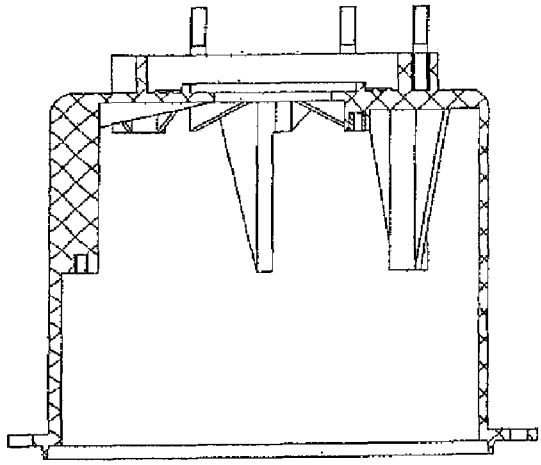
Figure 6C:
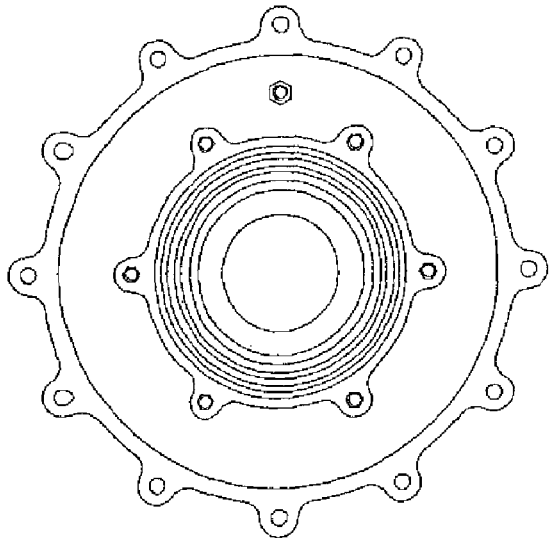
Figure 7A:
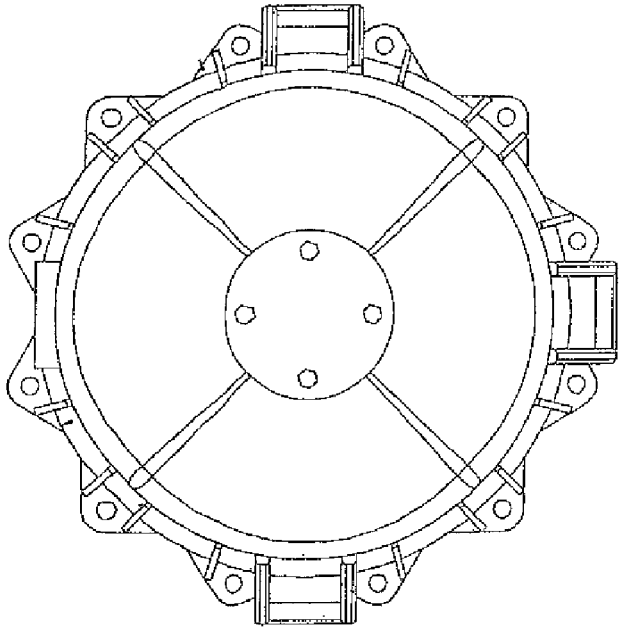
FIGS. 7A to C show bottom, side and top elevations of a base portion of a housing of a light assembly.
Figure 7B:
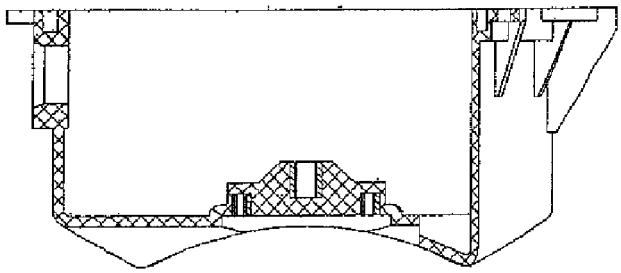
Figure 7C:
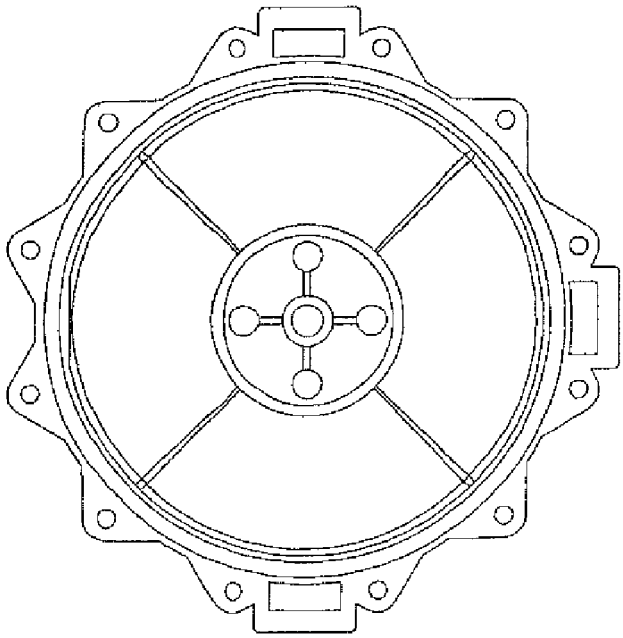

Referring to FIG. 5, it will be seen that base portion contains a ballast weight 20, secured in place by a bolt 22 and spread washer 23. The weight has a cutout or channel 32 to allow an unrestricted route for the supply cable from the cable gland to the upper part of the housing. This upper part houses the electrical components and circuitry necessary to make the lamp function. These include a ballast 12 and capacitor 11, a ceramic lamp holder or bulb holder 10 held in place by a bracket 9. Also attached to the upper portion is an eyelet bolt 29, shown in more detail in FIG. 12. This enables the light assembly to be raised and lowered into position.

Figure 8A:
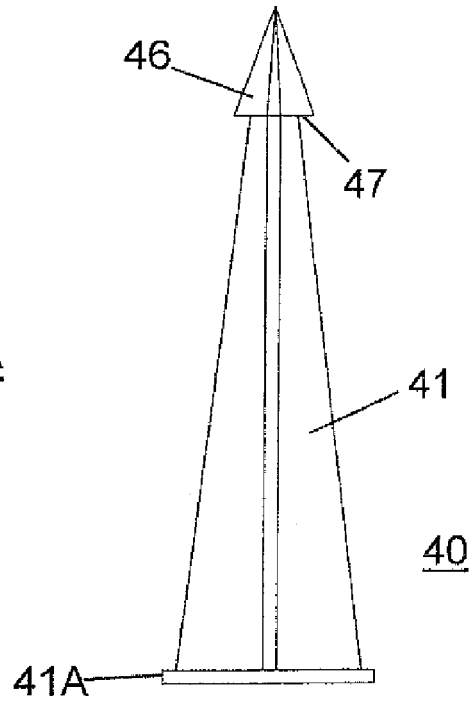
FIGS. 8A and B show a side and bottom elevations of a ground engaging spike.
Figure 8B:
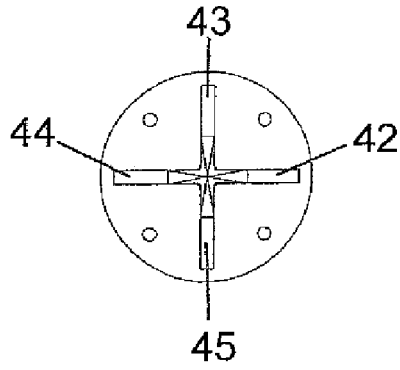

A key feature of the present invention relates to the provisions made to install the light assembly safely and securely. Firstly, a demountable ground-engaging spike 40 is provided, as shown in FIG. 8. This consists of a mounting plate 41A, designed to bolt onto the bottom of the base at a central point. The shaft of the spike 41 is formed from struts 42 to 45 arranged at right angles to each other in a crucifix form, and narrowing towards the tip region 46. The tip region has a similar form of construction and forms an arrowhead type of arrangement at the ground-engaging end of the spike, with shoulders 47 preventing easy removal of the spike, once it has been sunk into the ground.

Figure 17:
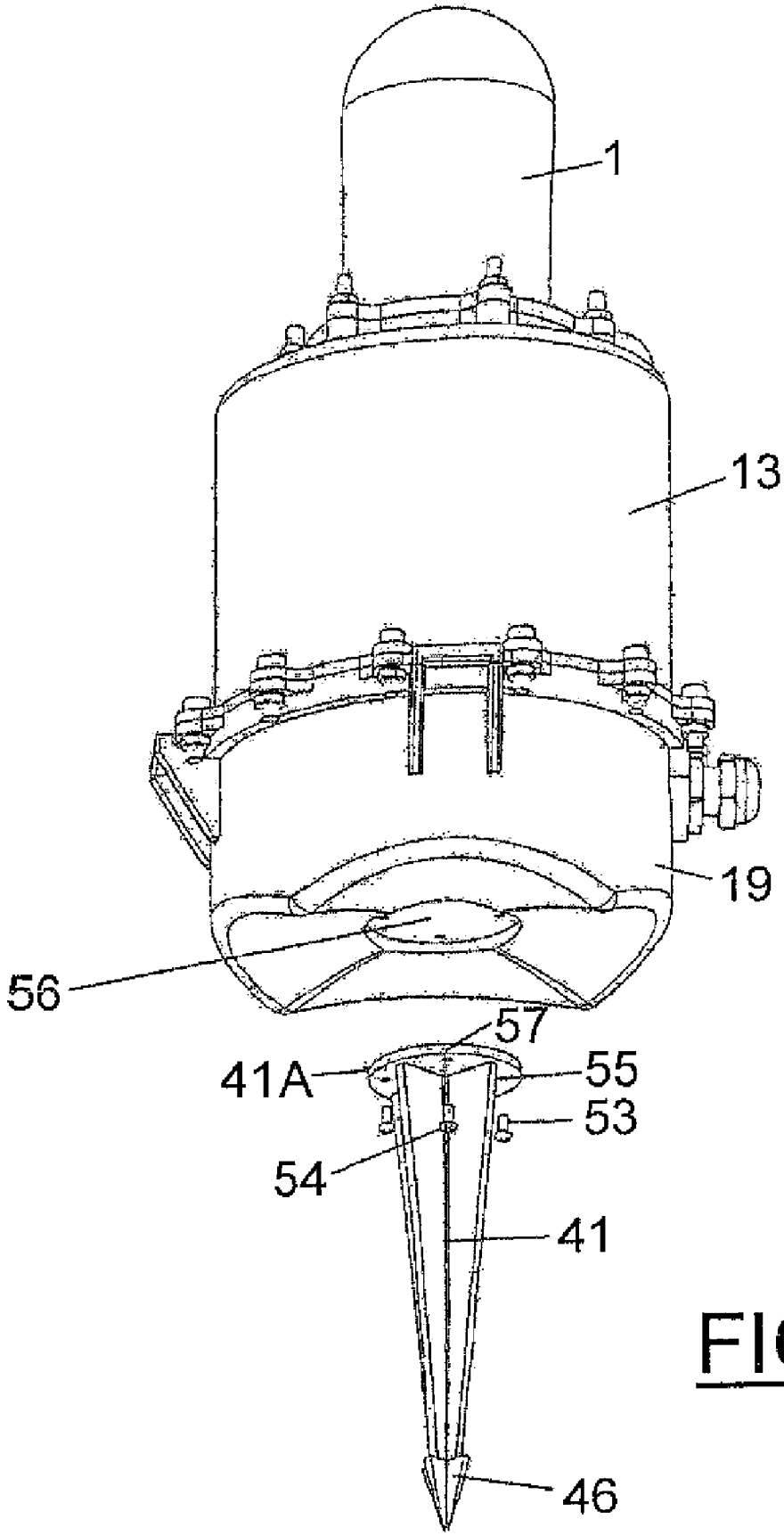
FIG. 17 shows the ground engaging spike and its connection to the base of the light assembly.

A further view of a ground-engaging spike, and its method of connection to the base of a light assembly, is shown in FIG. 17. A corresponding numbering system to that used in FIGS. 1 to 5 and 8 is used in FIG. 17. The base of the spike 41A is formed in the shape of a substantially flat flange. This flange engages into a correspondingly shaped recess 56 in the base 19. Apertures 55, 57 are provided in the flange 41A to accommodate bolts 53, 54. These bolts, four in total in this example, act as securing means to secure the spike 41 to the base 19. Corresponding threaded holes in the base are provided to accommodate these bolts. It follows therefore that the light assemblies of the present invention can be used with, or without, a ground engaging spike depending on the requirements of the installation.

The spike is demountable in order that the light assembly may also be secured directly to some underwater structure such as a pile or post, such as those used to support a jetty or deck. To facilitate this, the bottom of the base is profiled, in this case the base is concave in shape, as shown at 51 in FIG. 5 and 51 and 52 in FIG. 1. Preferably two concave shaped indentations are formed in the base bottom set at right angles to each other. In this way the light assembly can be placed against a circular pile in any one of 4 configurations. This is shown in FIG. 1 and ensures that the direction in which the electrical supply cable, which is both heavy and relatively inflexible, can be arranged to suit each particular installation.

Figure 13:
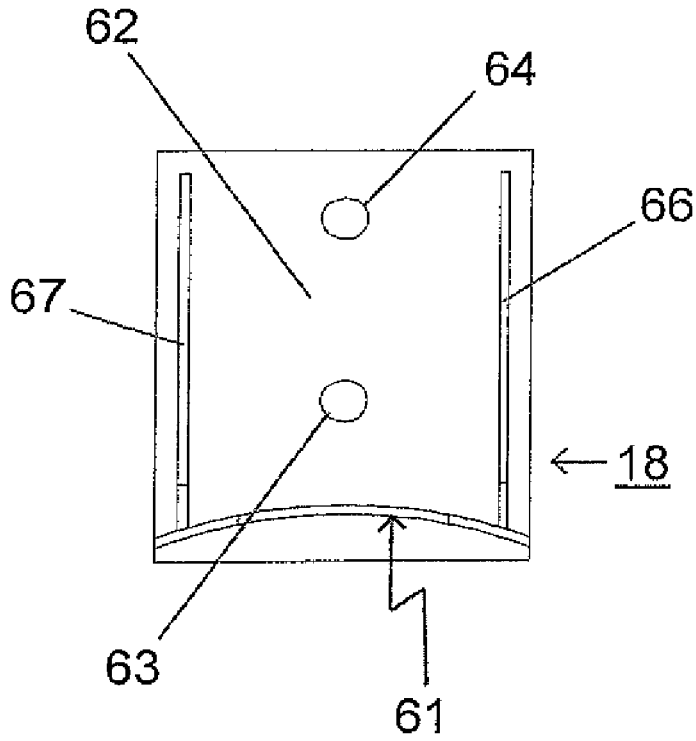
FIGS. 13, 14 and 15 show various elevations of a support bracket.
Figure 14:
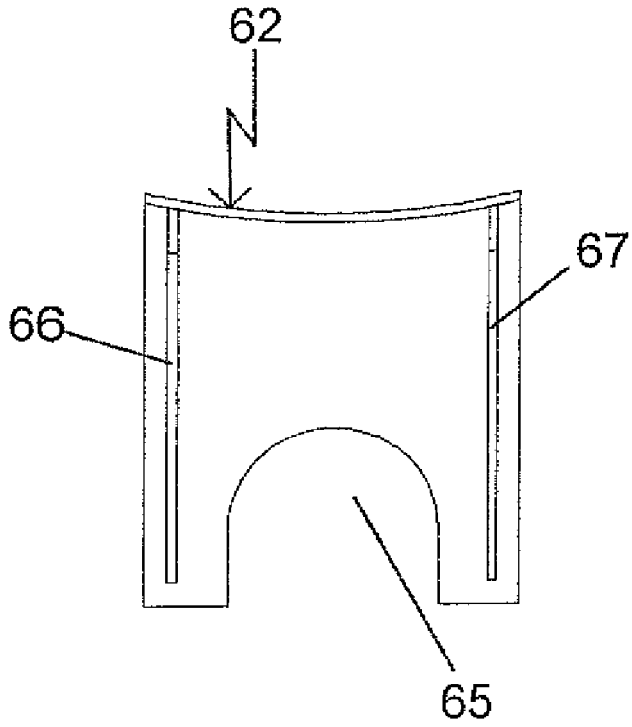
Figure 15:
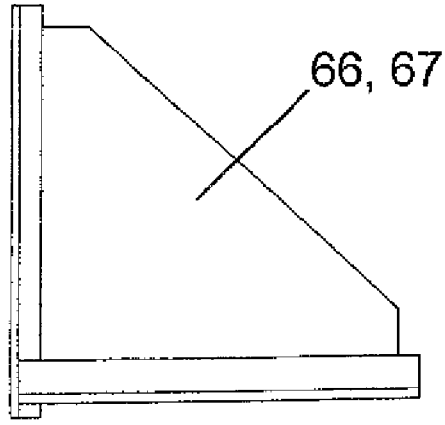

To facilitate installation against a post, a separate bracket 18 is provided as shown in FIGS. 13, 14 and 15. One face of the bracket 61 has a radius which corresponds to the radius of the base. In this way it fits snugly against the face of the circular cylindrical base body when in use. Extending away from the curved face, substantially at right angles is a face 62 containing two fixing holes 63,64. These holes are used to attach this face of the bracket to the pilework at the appropriate depth below the water. Face 62 is also curved, in this case of a radius to match that in the concave depressions in the bottom of the base portion. This leads to a snug, secure fit against the pilework.

A further feature of this bracket is a semi-circular cut out 65 in the face 61 which is in contact with the side of the base. This cut out fits around the cable gland 16 and acts to both locate and stabilize the assembly during and after installation. Sides of the bracket 66, 67 stretching between the two faces at right angles complete the bracket arrangement and add the necessary strength.

Figure 18:
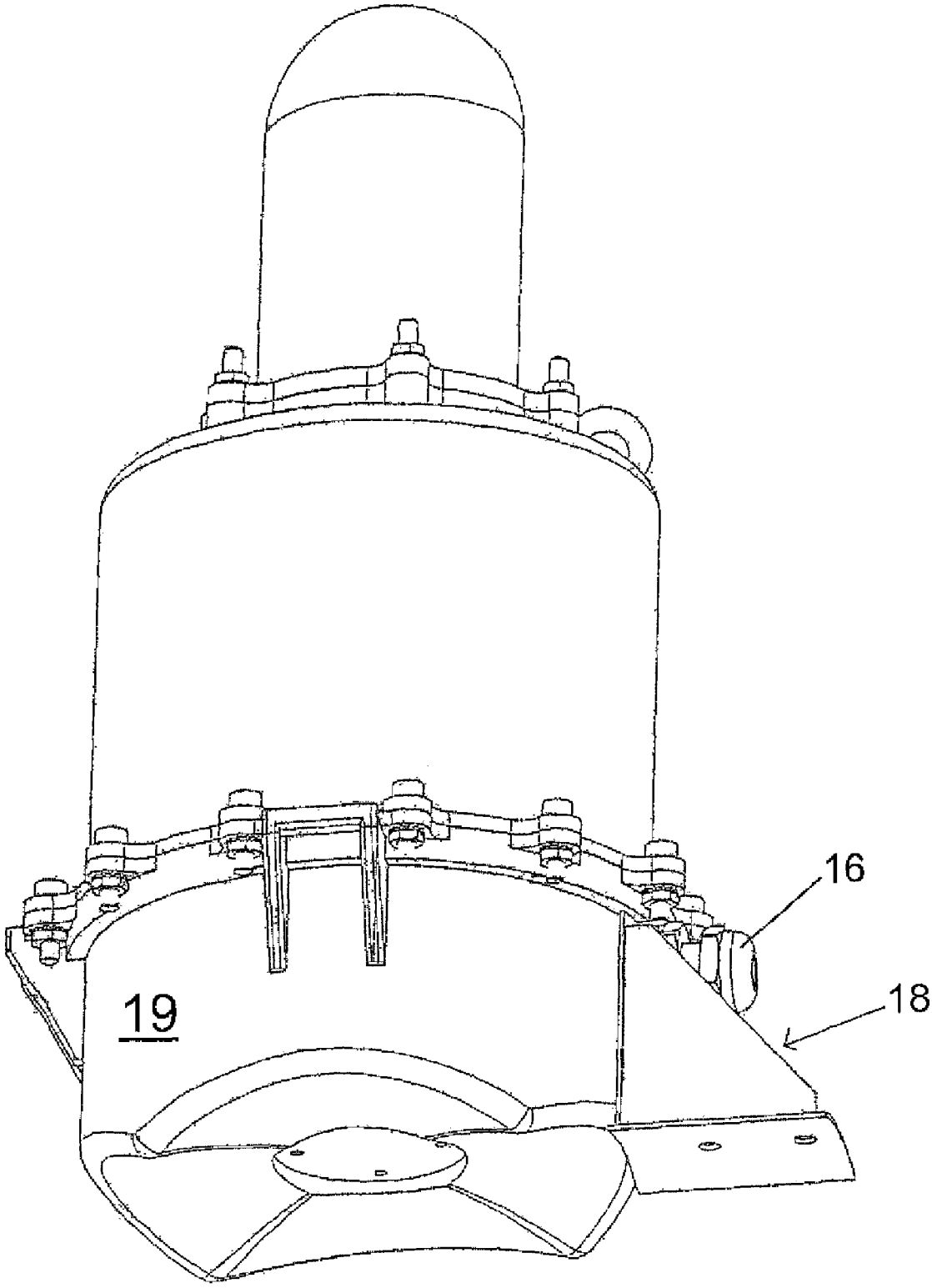
FIG. 18 shows a support bracket engaged around a cable entry point.

FIG. 18 shows a perspective view of a bracket 18 in position against the side of the base of a light assembly, nested around a cable gland 16. This illustrates the neatness of this type of fixing method.

Two methods of installation are shown in FIG. 16. In FIG. 16A the light assembly, with spike attached, is lowered from a boat and the spike sinks into or is driven into the sea or riverbed in the desired position.

Figure 16A:
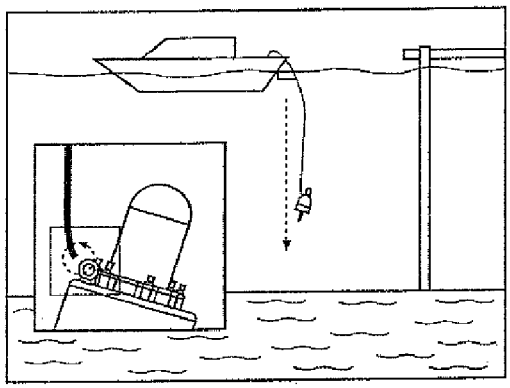
FIG. 16 shows various installation options.
Figure 16B:
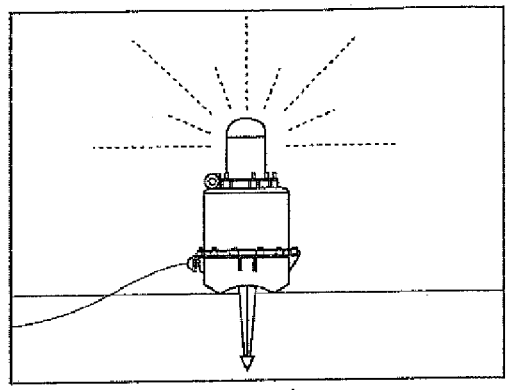
Figure 16D:
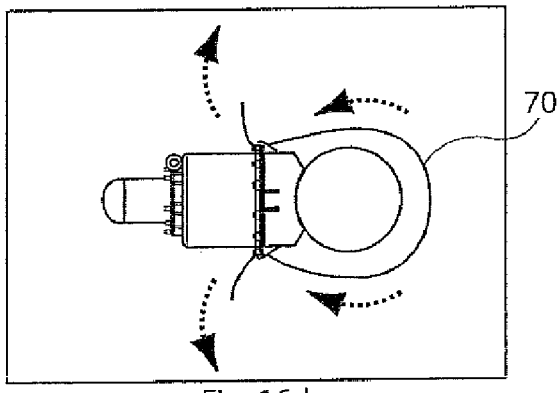
Figure 16C:
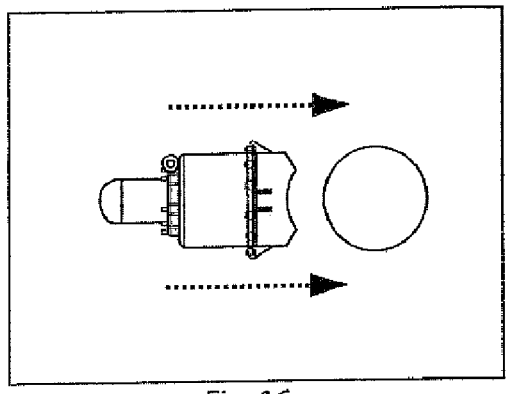
Figure 16E:
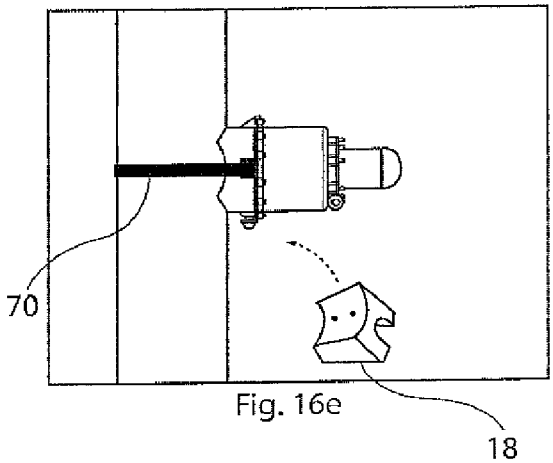
Figure 16F:
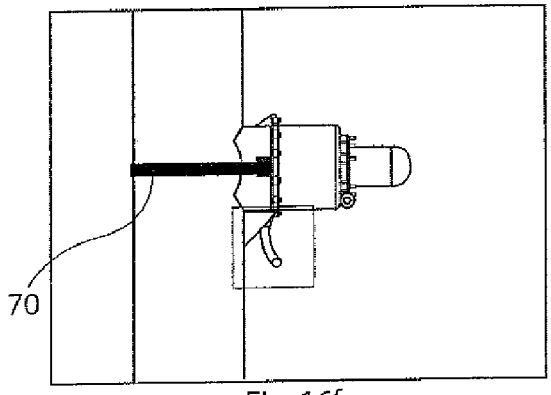

In FIG. 16C the light assembly is offered up to a pile or post below the water at the appropriate depth. A strap 70 is offered around the post and threaded through two of the eyelets 34, 35, 36 shown in FIG. 3. Pulling strap 70 tight secures the light assembly to the post. Bracket 18 is then offered up to the post and light assembly, slipped around the cable gland and secured in place to the post. This helps to take the weight of the light assembly and complete the installation.

Whilst a circular cylindrical light assembly has been described in this embodiment it will be appreciated that any substantially cylindrical form will work equally well and also that it is not even necessary for the assembly to be cylindrical in form.

TABLE 1

KEY TO FIG. 5

| Reference Numeral | Designation | Number | Material |
|---|---|---|---|
| 32 | | | |
| 31 | Ground spike | 1 | ABS |
| 29 | Eyelet bolt M8 | 1 | Stainless Steel |
| 28 | Hex. Nut M4 | 4 | |
| 27 | Ballast bracket | 1 | Iron Plate |
| 26 | Round head bolt M5 × 10 | 4 | |
| 25 | Round head bolt M4 × 55 | 4 | |
| 24 | Body seal | 1 | Silicone |
| 23 | Washer | 1 | |
| 22 | Hex. Bolt M10 × 65 | 1 | |
| 21 | Gasket | 1 | Silicone |
| 20 | Loader | 1 | |
| 19 | Bottom lamp body | 1 | PSU |
| 18 | Support bracket | 1 | |
| 17 | Bush | 1 | |
| 16 | Cable gland | 1 | |
| 15 | Hex. Nut M8 | 12 | |
| 14 | Allen screw bolt M8 × 25 | 12 | |
| 13 | Top lamp body | 1 | |
| 12 | 250 W ballast | 1 | |
| 11 | 18UF capacitor | 1 | |
| 10 | Lamp holder bolt | 2 | |
| 9 | Lamp holder bracket | 1 | |
| 8 | Ceramic lamp holder | 1 | |
| 7 | Round head bolt M5 × 10 | 2 | |
| 6 | Glass shade seal | 1 | Silicone |
| 5 | Washer | 1 | PSU |
| 4 | Butterfly nut M8 × 1.25 | 6 | POM |
| 3 | Bolt | 6 | Stainless Steel |
| 2 | 250 W Hg lamp | 1 | |
| 1 | Glass shade | 1 | Toughened glass |

The invention claimed is:

1. A submersible light assembly comprising:

(i) at least one light source;

(ii) a watertight housing having a base, at least one sidewall and a transparent envelope enclosing a portion of the light source;

wherein the base incorporates two concave indentations set substantially orthogonal to each other to substantially conform to the profile of the surface profile of pilework of the type associated with a jetty such that the light assembly can be places against the pilework in any one of 4 configurations.

2. A submersible light assembly as claimed in claim 1 further comprising a support bracket adapted to be secured to pilework and to partially take the weight of said light assembly.

3. A submersible light assembly as claimed in claim 2 further comprising a cable entry point adapted to form a waterproof seal between an electrical cable or conduit and said assembly wherein the support bracket is so sized and shaped to be adapted to engage with said cable entry point in order to partially support said lamp assembly in use.

4. A submersible light assembly as claimed in claim 1 further comprising a cable entry point adapted to form a waterproof seal between an electrical cable or conduit and said assembly.

5. A submersible light assembly as claimed in claim 1 further comprising eyelets adapted to accommodate one or more straps to strap said light assembly to a pile.

6. A submersible light assembly as claimed in claim 1 further comprising a demountable ground engaging spike.

7. A submersible light assembly as claimed in claim 6 wherein said demountable ground engaging spike is secured to said base of the light assembly using spike securing fixture.

8. A submersible light assembly as claimed in claim 1 wherein said housing comprises a base, a body portion and said transparent envelope with sealing gaskets between adjacent components.

9. A submersible light assembly as claimed in claim 1 wherein said base incorporates a weight.

10. A submersible light assembly as claimed in claim 1 wherein said base incorporates a weight.

11. A submersible light assembly comprising:

(i) at least one light source;

(ii) a watertight housing having a base, at least one sidewall and a transparent envelope enclosing a portion of the light source;

(iii) a demountable ground engaging spike; and (iv) further comprising eyelets adapted to accommodate one or more straps to strap said light assembly to a pile.

12. A submersible light assembly as claimed in claim 11 further comprising a support bracket adapted to be secured to pilework and to partially take the weight of said light assembly.

13. A submersible light assembly as claimed in claim 12 further comprising a cable entry point adapted to form a waterproof seal between an electrical cable or conduit and said assembly wherein the support bracket is so sized and shaped to be adapted to engage with said cable entry point in order to partially support said lamp assembly in use.

14. A submersible light assembly as claimed in claim 11 further comprising a cable entry point adapted to form a waterproof seal between an electrical cable or conduit and said assembly.

15. A submersible light assembly as claimed in claim 11 wherein said demountable ground engaging spike is secured to said base of the light assembly using spike securing fixture.

16. A submersible light assembly as claimed in claim 11 wherein said housing comprises a base, a body portion and said transparent envelope with sealing gaskets between adjacent components.

17. A submersible light assembly comprising:

(i) at least one light source;

(ii) a watertight housing having a base, at least one sidewall and a transparent envelope enclosing a portion of the light source; and (iii) eyelets adapted to accommodate one or more straps to strap the light and assembly to a pile of the type associated with a jetty.

18. A submersible light assembly as claimed in claim 17 wherein at least a portion of an outer face of said base of the housing is profiled to substantially conform to the profile of the surface profile of pilework of the type associated with a jetty.

19. A submersible light assembly as claimed in claim 18 wherein at least a portion of said outer face of said base of said housing is curved.

20. A submersible light assembly as claimed in claim 19 wherein a portion of said base is concave.

21. A submersible light assembly as claimed in claim 18 wherein said base incorporates two concave indentations set substantially orthogonal to each other.

22. A submersible light assembly as claimed in claim 17 further comprising a support bracket adapted to be secured to pilework and to partially take the weight of said light assembly.

23. A submersible light assembly as claimed in claim 22 further comprising a cable entry point adapted to form a waterproof seal between an electrical cable or conduit and said assembly wherein the support bracket is so sized and shaped to be adapted to engage with said cable entry point in order to partially support said lamp assembly in use.

24. A submersible light assembly as claimed in claim 17 further comprising a cable entry point adapted to form a waterproof seal between an electrical cable or conduit and said assembly.

25. A submersible light assembly as claimed in claim 17 further comprising a demountable ground engaging spike.

26. A submersible light assembly as claimed in claim 25 wherein said demountable ground engaging spike is secured to said base of the light assembly using spike securing fixture.

27. A submersible light assembly as claimed in claim 17 wherein said housing comprises a base, a body portion and said transparent envelope with sealing gaskets between adjacent components.

28. A submersible light assembly as claimed in claim 17 wherein said base incorporates a weight.

* * * * *

UNITED STATES PATENT AND TRADEMARK OFFICE

CERTIFICATE OF CORRECTION

PATENT NO. : 7,997,765 B2
APPLICATION NO. : 12/212574
DATED : August 16, 2011
INVENTOR(S) : Johnson It is certified that error appears in the above-identified patent and that said Letters Patent is hereby corrected as shown below:

Claim 1, Col. 5, line 47 "be places against" should be -- be placed against --.

Signed and Sealed this
Twenty-third Day of October, 2012

David J. Kappos

David J. Kappos
*Director of the United States Patent and Trademark Office*